US007273155B1

(12) United States Patent
Gray

(10) Patent No.: US 7,273,155 B1
(45) Date of Patent: Sep. 25, 2007

(54) TRASH RECEPTACLE WITH SUCTION MEANS FOR DRAWING A FLEXIBLE BAG LINER AGAINST ITS INTERIOR WALLS

(76) Inventor: Robert R. Gray, 502 S. Post Oak La., Suite 10, Houston, TX (US) 77056

( * ) Notice: Subject to any disclaimer, the term of this patent is extended or adjusted under 35 U.S.C. 154(b) by 918 days.

(21) Appl. No.: 10/068,575

(22) Filed: Feb. 6, 2002

Related U.S. Application Data

(60) Provisional application No. 60/266,591, filed on Feb. 6, 2001.

(51) Int. Cl.
*B65F 1/06* (2006.01)

(52) U.S. Cl. ..... 220/495.04; 220/908; 220/8

(58) Field of Classification Search ..... 220/908, 220/908.1, 8, 495.04, 495.02, 495.06, 495.08, 220/495.11, 23.83, 23.86, 23.87; 206/514; 222/173, 609, 481–482, 485
See application file for complete search history.

(56) References Cited

U.S. PATENT DOCUMENTS 4,294,379 A 10/1981 Bard
4,890,760 A 1/1990 Nicoll, Sr. et al.
5,143,242 A * 9/1992 Millasich ..... 220/495.02
6,015,063 A 1/2000 Poliquin

* cited by examiner

*Primary Examiner*—Stephen Castellano
(74) *Attorney, Agent, or Firm*—Kenneth A. Roddy

(57) ABSTRACT

A trash receptacle that receives and supports a flexible trash bag liner and sucks the empty flexible liner tight against the interior surfaces of the receptacle in a full open position absent any air pockets or billowing by extracting air trapped between the exterior surface of the liner and the interior surfaces of the receptacle.

3 Claims, 16 Drawing Sheets

TRASH RECEPTACLE WITH SUCTION MEANS FOR DRAWING A FLEXIBLE BAG LINER AGAINST ITS INTERIOR WALLS

CROSS-REFERENCE TO RELATED APPLICATION

This application claims priority of U.S. Provisional Patent Application Ser. No. 60/266,591, filed Feb. 6, 2001.

BACKGROUND OF THE INVENTION

1. Field of the Invention

This invention relates generally to wastebaskets and trash receptacles of the type that receive flexible bag liners and, more particularly, to a trash receptacle having suction means for drawing a flexible bag liner into place against the interior walls of the receptacle during installation.

2. Description of the Prior Art

Wastebaskets, trash cans, and trash receptacles of various designs and configurations of the type that receive a flexible "trash bag" liner are known in the prior art. There are two problems associated with installing and removing these very thin flexible trash bag liners. The first problem occurs when initially installing the liner. Usually the flexible liner is opened and placed into the receptacle and its open end is fitted over the top edge of the receptacle, forming a seal. As a result, air is trapped between the exterior of the liner and the interior wall surfaces of the receptacle causing the liner to puff up or billow inwardly away from the interior bottom and side surfaces of the receptacle and prevents it from assuming a desired full open configuration. After several items have been placed into the lined receptacle, the weight and/or volume inside the liner causes the air trapped between the exterior of the liner and interior of the receptacle to slowly leak out at the top end where the liner is fitted over the top edge of the receptacle. As the trash liner becomes filled, its exterior will gradually engage or closely conform to the interior bottom and side surfaces of the receptacle.

The second problem occurs when removing the filled flexible liner from its trash receptacle in that when the bag is lifted upwardly a vacuum is created between the exterior bottom and sides of the departing liner and the interior bottom and side surfaces of the receptacle, making it difficult to remove the flexible trash liner because the greater ambient air pressure holds the flexible, collapsible trash liner within the trash receptacle.

There are several patents that disclose wastebaskets, trash cans, and trash receptacles of various designs and constructions which are configured to overcome problems associated with removing the flexible trash bag liner. Most of these prior art devices are designed to eliminate the vacuum created when removing or lifting a filled flexible liner from the trash receptacle; however, none of these devices are capable of drawing the flexible liner into a desirable full open configuration against the interior walls of the receptacle during installation of the liner.

Bard, U.S. Pat. No. 4,294,379 discloses an upwardly vented trash receptacle provided with a plurality of longitudinal peripherally positioned hollow tubes in the interior of the trash receptacle through which ambient air is allowed to travel to reduce the vacuum created in the vacant space immediately below the flexible trash liner and reduce the total force required to remove the filled liner.

Poliquin, U.S. Pat. No. 6,015,063 discloses a trash can vent system that includes one or more vent channels that are securable to the interior corners of a conventional trash can, each channel having a number of vent openings to prevent the trash can liner from forming a vacuum seal with the interior trash can side walls.

Nicoll, Sr., et al, U.S. Pat. No. 4,890,760 discloses a trash receptacle including a flexible diaphragm valve mounted in the bottom thereof for breaking a suction which is created when the filled trash liner positioned within the receptacle is lifted for the purposes of trash removal. The flexible diaphragm remains in sealing engagement with the inside surface of the container and covers air holes extending from the outside surface to the inside surface of the container. When the liner is lifted, the diaphragm flexes upwardly due to the suction pressure and allows air to flow inwardly to break the suction.

The present invention substantially departs from and is distinguished over the prior art in general, and these patents in particular, by a trash receptacle that receives and supports a flexible trash bag liner therein and sucks the empty flexible liner tight against the interior surfaces of the receptacle in a full open position absent any air pockets or billowing by extracting air trapped between the exterior surface of the liner and the interior surfaces of the receptacle.

SUMMARY OF THE INVENTION

It is therefore an object of the present invention to provide a trash receptacle having suction means for extracting air trapped between the interior surfaces of the receptacle and the outer surface of a flexible trash bag liner placed therein.

It is another object of this invention to provide a trash receptacle having suction means for drawing a flexible liner placed therein tight against the interior surfaces of the receptacle in a full open position absent any air pockets or billowing.

Another object of this invention is to provide a trash receptacle having a stationary lower portion and a vertically movable upper portion which, when moved relative to the lower portion, creates a suction to draw a flexible liner placed therein tight against the interior surfaces of the receptacle in a full open position absent any air pockets or billowing.

Another object of this invention is to provide a trash receptacle having a vertically movable bottom which, when pushed downwardly, creates a suction to draw a flexible liner placed in the receptacle tight against the interior surfaces of the receptacle in a full open position absent any air pockets or billowing.

Another object of this invention is to provide a trash receptacle having air extraction means at a lower end thereof that evacuates air trapped between the interior surfaces of the receptacle and the outer surface of a flexible trash bag liner placed therein and creates a suction to draw the liner tight against the interior surfaces of the receptacle in a full open position absent any air pockets or billowing.

A further object of this invention is to provide a trash receptacle having air extraction means which may be operated manually, mechanically or electrically that extracts air trapped between the interior surfaces of the receptacle and the outer surface of a flexible trash bag liner placed therein and creates a suction to draw the liner tight against the interior surfaces of the receptacle in a full open position absent any air pockets or billowing.

A still further object of this invention is to provide a trash receptacle having suction means for drawing a flexible liner placed therein tight against the interior surfaces of the receptacle, which is attractive in appearance, simple in construction, and inexpensive to manufacture.

Other objects of the invention will become apparent from time to time throughout the specification and claims as hereinafter related.

The above noted objects and other objects of the invention are accomplished by a trash receptacle that receives and supports a flexible trash bag liner therein and sucks the empty flexible liner tight against the interior surfaces of the receptacle in a full open position absent any air pockets or billowing by extracting air trapped between the exterior surface of the liner and the interior surfaces of the receptacle.

DESCRIPTION OF THE PREFERRED EMBODIMENTS

Figure 1:
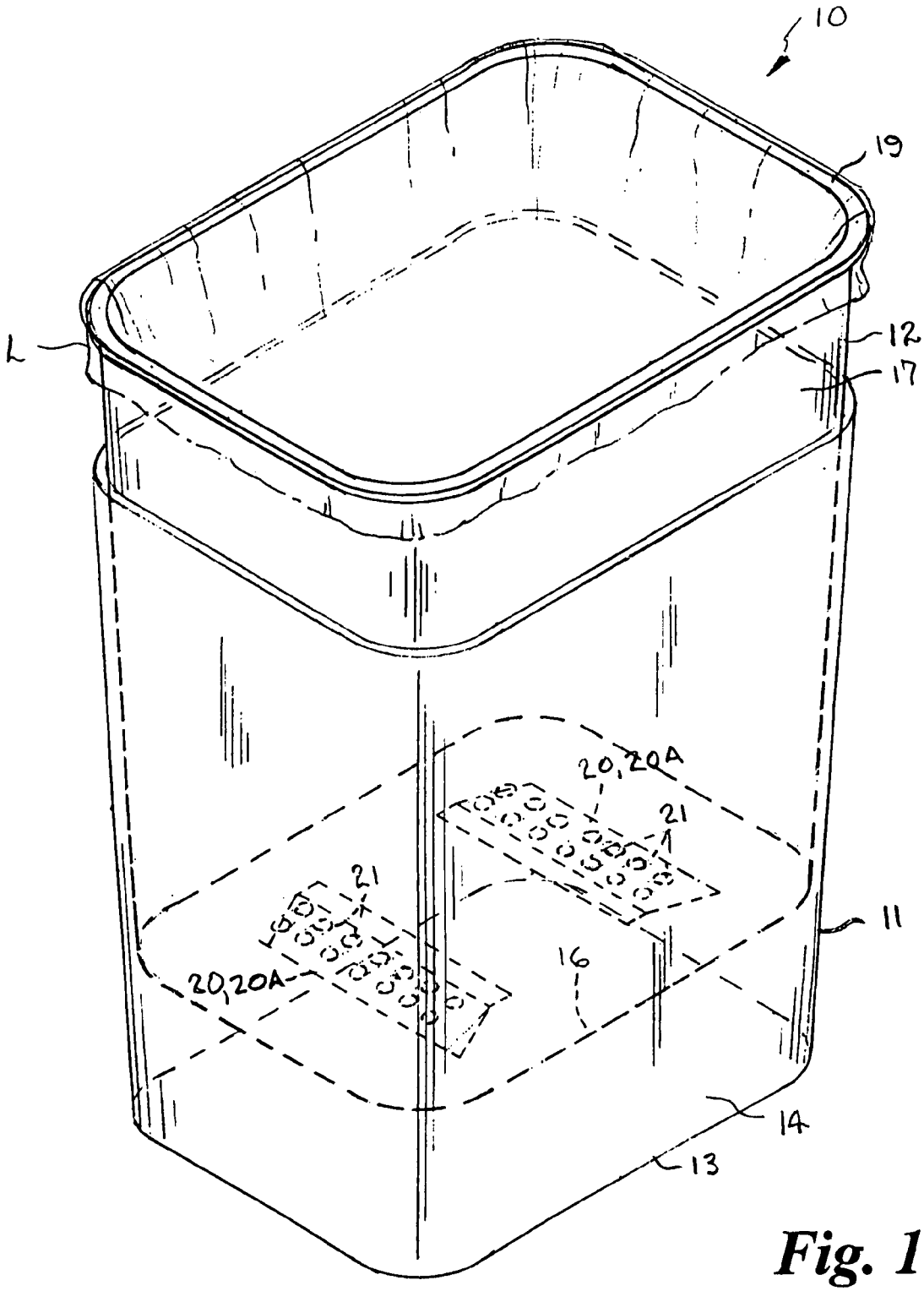
FIG. 1 is an isometric view of the trash receptacle in accordance with a first embodiment of the present invention having a resilient member disposed between the inner receptacle and outer base member.

In the following discussion, various embodiments of the trash receptacle container are shown in the drawings as generally rectangular or elliptical and are described as having a perimeter side wall, however, it should be understood that the trash receptacle container may be of square, rectangular, oval, circular or other suitable configuration.

Resiliently Biased Embodiment

Referring now to drawings 1, 1A, 1B and IC, there is shown a trash receptacle 10 in accordance with a first preferred embodiment of the present invention. The trash receptacle 10 comprises an outer base member 11 and an inner receptacle member 12 for receiving and supporting a trash bag liner L therein. The outer base member 11 has a bottom wall 13 and a tapered perimeter side wall 14 extending upwardly therefrom circumscribing a lower chamber 15 with an open top end.

The inner receptacle member 12 has a bottom wall 16 and a tapered peripheral side wall 17 extending upwardly therefrom from circumscribing a central chamber 18 with an open top end surrounded by a lip 19. The tapered perimeter side wall 17 of the inner receptacle member 12 is sized and shaped to be slidably received inside the tapered perimeter side wall 14 of the outer base member 11 and to reciprocate telescopically in the lower chamber 15 relative to the base member 11. At least one one-way valve means 20 is disposed on the bottom wall 16 of the inner receptacle member 12 for venting air only out of the central chamber 18, as described hereinafter. In the illustrated embodiment, there are two valve means shown generally centered on the bottom wall, however, any number of valves my be used and they may be disposed at various locations, for example near the corners of the bottom wall.

Figure 2:
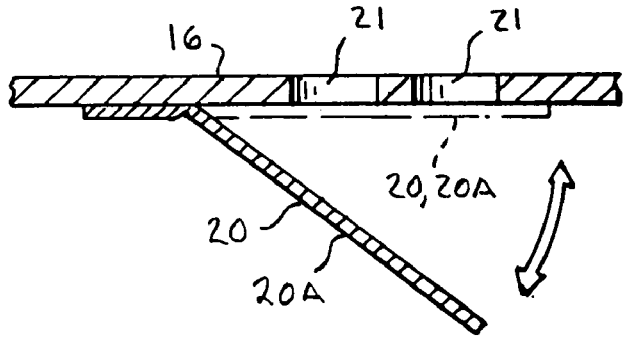
FIG. 2 is a partial cross section of a one-way flapper valve element.

FIG. 2 shows an enlarged detail of the one-way valve means 20. A plurality of apertures 21 are formed in the bottom wall 16. A semi-rigid flexible strip 20A has a first portion secured to the underside of the bottom wall 16 of the inner receptacle member 12 and a second portion that is free to pivot or flex. The second portion of the strip 20A pivots or flexes upon air entering or leaving the central chamber 18 and operates as a flapper valve to move between a closed position covering the apertures 21 to prevent air from entering the central chamber and an open position extended away from the apertures to allow air to be expelled through the apertures.

A resilient member 22 is disposed between the bottom wall 16 of the inner receptacle member 12 and the bottom wall 13 of the outer base member 11. The resilient member 22 functions to resiliently bias the bottom wall 16 of the inner receptacle member 12 upwardly relative to the outer base member 11. When the inner receptacle member 12 is biased upwardly or raised relative to the outer base member 11, an annulus or gap 23 is formed between the exterior of the tapered peripheral side wall 17 of the inner receptacle member 12 and the interior of the tapered peripheral side wall 14 of the outer base member 11.

The resilient member 22 may be of any suitable resilient construction. In the illustrated example, the resilient member 22 is formed of one or more pads of resilient elastomeric foam material installed on either of the bottom walls 16 or 13 by a "peel and stick" adhesive strip 22A. Alternatively, the resilient member 22 may be formed of a curved or bowed strip of resilient material that operates in the manner of a leaf spring, and may be secured on either of the bottom walls 16 or 13, or may be a loose member that is simply placed in the bottom of the outer base member 11. It should be understood that various other forms of the resilient member may be used, such as coiled, bent, or looped spring elements.

Operation of Resiliently Biased Embodiment

Figure 1A:
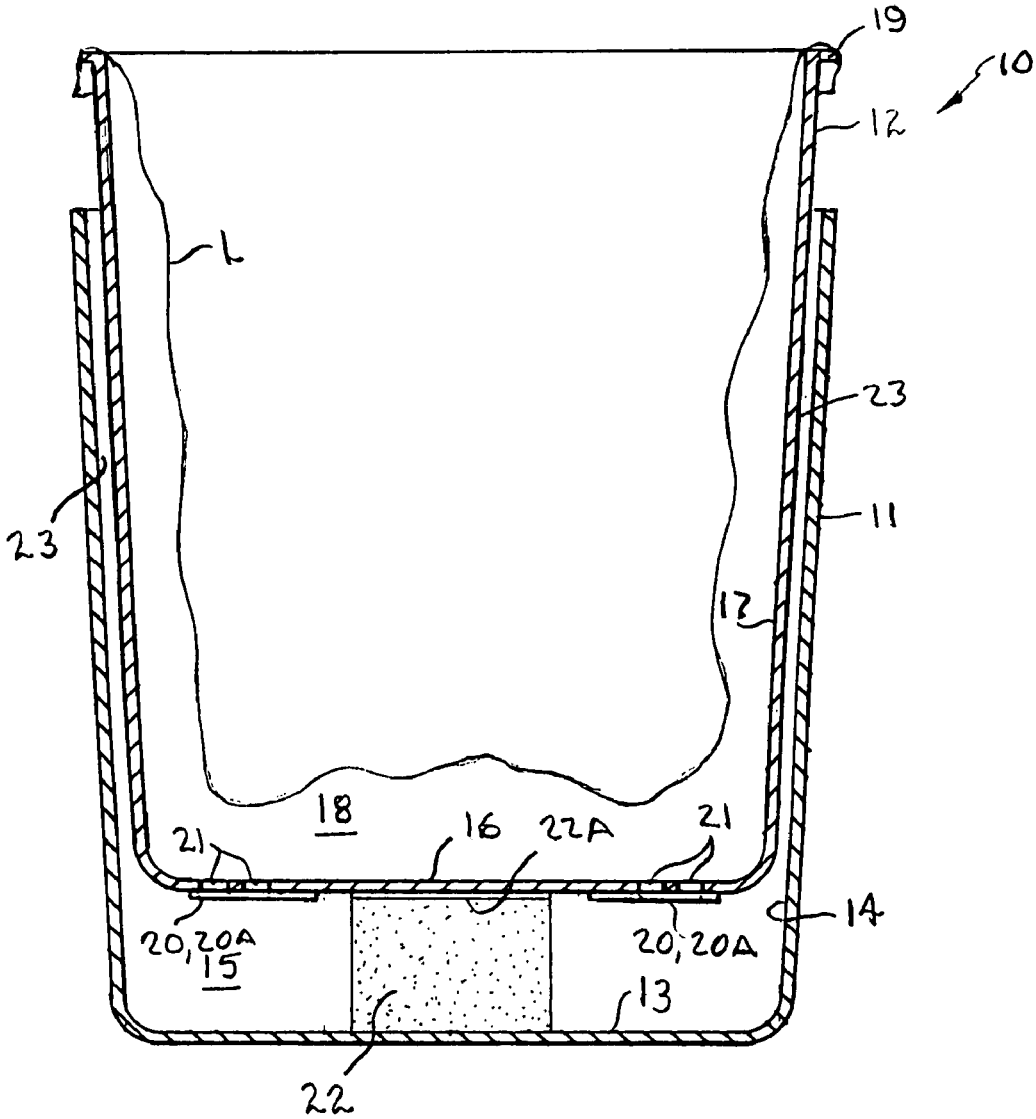
FIGS. 1A, 1B and 1C are longitudinal cross sectional views of the trash receptacle of FIG. 1, showing the inner receptacle in its at rest position, its lower position and its upper position, respectively.

Referring now to FIG. 1A, the inner receptacle member 12 of the trash receptacle 10 is shown in its at-rest position nested within the outer base member 11, and the resilient member 22 in its expanded position engaged between the bottom wall 16 of the inner receptacle member and the bottom wall 13 of the outer base member. In this position, the trash receptacle 10 resembles a conventional trash receptacle and the one-way valve means 20 of the inner receptacle member 12 are in a closed or neutral position and there is a small annulus or gap 23 between the exterior of the tapered perimeter side wall 17 of the inner receptacle member 12 and the interior of the tapered perimeter side wall 14 of the outer base member 11.

A flexible trash bag liner L is opened and placed into the central chamber 18 of the inner receptacle member 12 and its open end is fitted over the lip 19 at the top end of the inner receptacle member in a conventional manner, forming a seal. As the liner L is installed, air is trapped between the exterior of the liner and the interior surfaces of the bottom wall 16 and peripheral side wall 17 of the inner receptacle member 12 causing the liner to puff up or billow inwardly away from the interior bottom and side surfaces.

The user pushes the inner receptacle member 12 downwardly relative to the outer base member 11 against the resistive force of the resilient member 22. As the bottom wall 16 of the inner receptacle member 12 moves downwardly, it acts as a piston moving in the lower chamber 15 of the base member 11. Because the one-way valve means 20 are closed, the volume of the lower chamber 15 is reduced, and air between the exterior of the inner receptacle member 12 and interior of the outer base member 11 is expelled to the atmosphere through the annulus or gap 23.

Figure 1B:
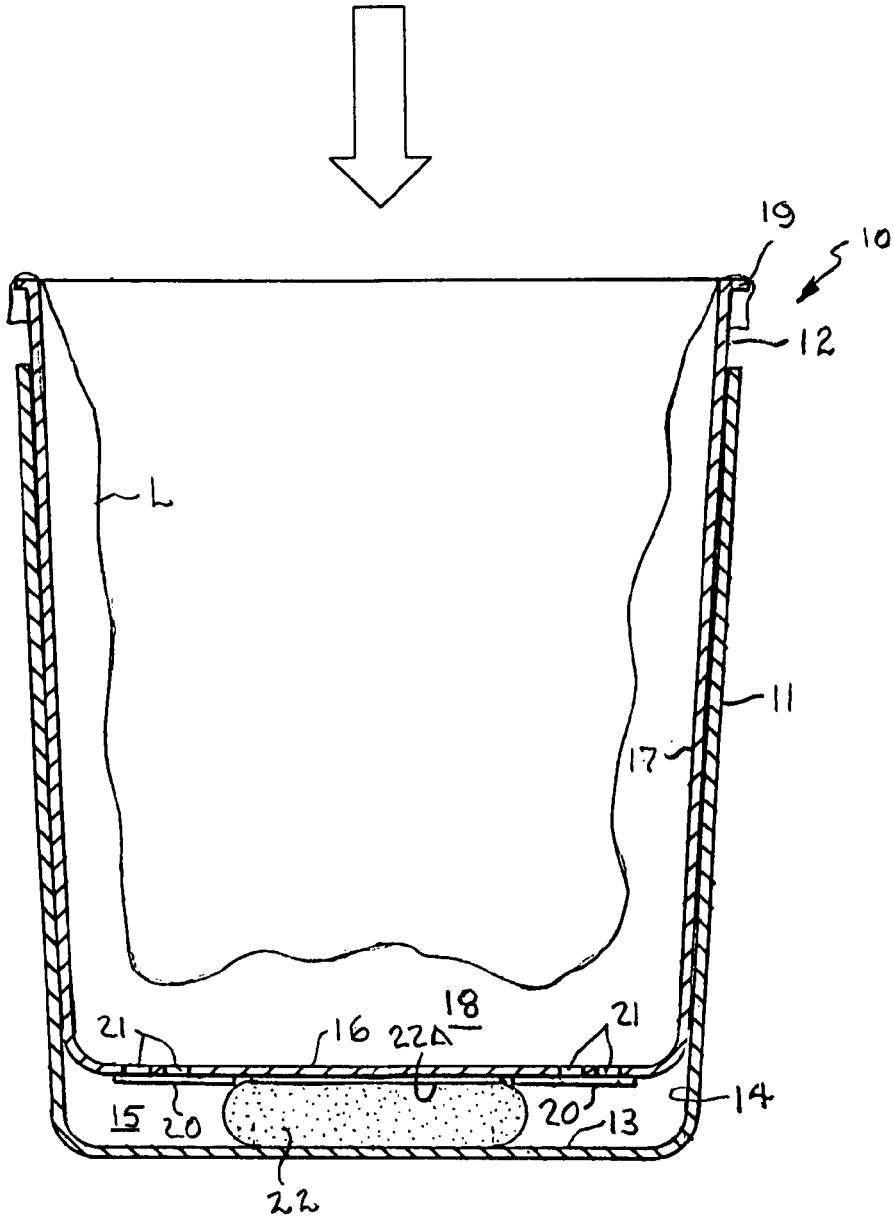
Figure 1C:
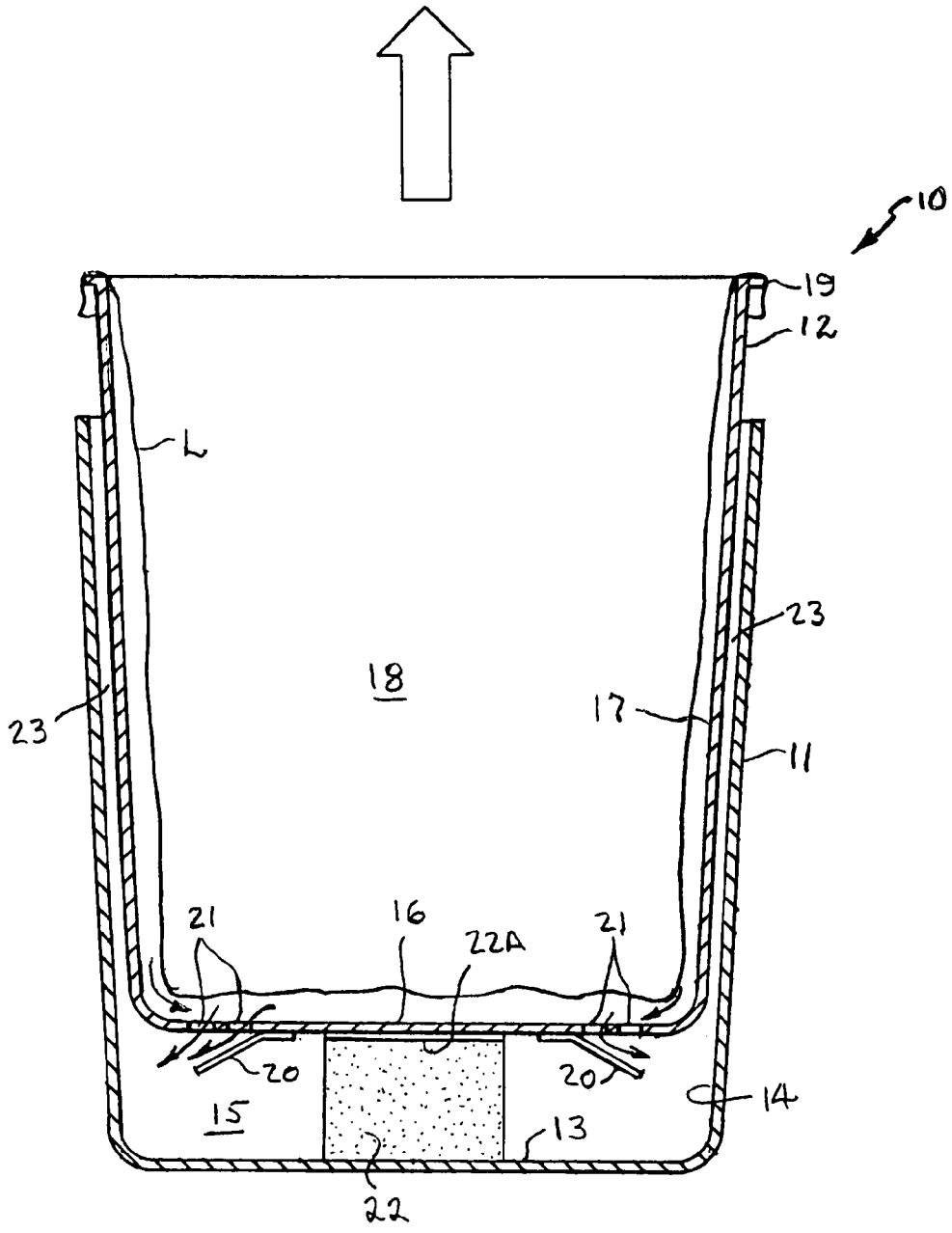

As shown in FIG. 1B, when the inner receptacle member 12 reaches its lowermost position, the resilient member 22 is compressed. As shown in FIG. 1C, downward pressure on the inner receptacle member 12 is then released and the resilient member 22 expands and raises the inner receptacle member 12 relative to the outer base member 11.

As the bottom wall 16 of the inner receptacle member 12 moves upwardly, the one-way valves 22 open and the volume of the lower chamber 15 increases and air pressure in the lower chamber is reduced relative to that of the ambient air pressure inside the inner receptacle member and liner installed therein, thereby allowing air to be extracted into the relatively lower pressure volume of the lower chamber 15. The angle of the tapered side walls 17 and 14 allows them to separate slightly as the inner receptacle moves upward to form the small annulus or gap 23 therebetween, but the angle is sufficiently small to allow only a small volume of air to enter through the gap.

The volume of air entering through the annulus or gap 23 is much less than the volume of air trapped between the exterior of the liner L and interior surfaces of the inner receptacle member 12. Thus, a large volume of the air trapped between the exterior of the liner L and interior surfaces of the inner receptacle member 12 will be extracted into the lower chamber 15. As the trapped air is extracted into the lower chamber 15, a vacuum is created between the exterior of the liner L and interior surfaces of the inner receptacle 12 which sucks or draws the flexible liner toward the interior surfaces of the bottom wall 16 and peripheral side wall 17 of the inner receptacle. After several up and down reciprocating motions of the inner receptacle member 12, the liner L is drawn tight against the interior surfaces of the inner receptacle member.

Thus, with several simple up and down strokes of the inner receptacle member 12, the user is provided with a trash receptacle having a removable liner that is drawn tight against the interior surfaces of the inner receptacle member in a full open position and absent any air pockets or billowing and which allows unobstructed use of the full volume of the trash receptacle.

To remove the liner L after it has been filled with trash, the user grasps the open top end of the liner and gathers it together, thereby releasing the vacuum between the exterior of the liner and the interior surfaces of the inner receptacle member 12, and pulls the liner upwardly from the inner receptacle member.

Embodiment with Hold-Down Means

Referring now to drawings 3A, 3B and 3C, there is shown a second embodiment of the trash receptacle 30 similar to the one previously described but without the resilient member and wherein the inner receptacle is moved up and down manually. In the following discussion, the components which are substantially similar to those previously described are assigned the same numerals of reference, but will not be described again it detail to avoid repetition.

The outer base member 11 has a bottom wall 13, a tapered perimeter side wall 14 circumscribing a central chamber 15 with an open top end, as described previously. In this embodiment, the outer base member 11 is provided with hold-down means for holding it down against the floor when the inner receptacle 12 is raised relative thereto.

The inner receptacle member 12 has a bottom wall 16, a tapered peripheral side wall 17 circumscribing a central chamber 18 with an open top end surrounded by a lip 19, and one-way valve means 20 on the bottom wall, as described previously.

The hold-down means may be a weight W placed in the bottom of the base member. The weight W may be, for example, a small amount of powered material such as concrete or plaster of Paris mixed with water and allowed to set, a bag filled with liquid, or any other suitable means for providing sufficient weight to the outer base member. The lower portion of the outer base member 11 may be provided with one or more spacers 13A to prevent the bottom wall 16 of the upper receptacle member 12 from contacting the weight W in its lowermost position.

Alternatively, as shown in dashed line, the hold-down means may comprise generally flat extensions that extend outward in a horizontal plane from the bottom wall 13 of the base member 11 in laterally opposed relation, for receiving the feet of a user to hold the base member down against the upward force of the inner receptacle member 12 during upward movement of the inner receptacle member. The extensions may be retractable. Alternatively, the bottom portion of the side wall 14 may be contoured inwardly to receive the feet of the user.

Operation Embodiment with Hold-Down Means

Figure 3A:
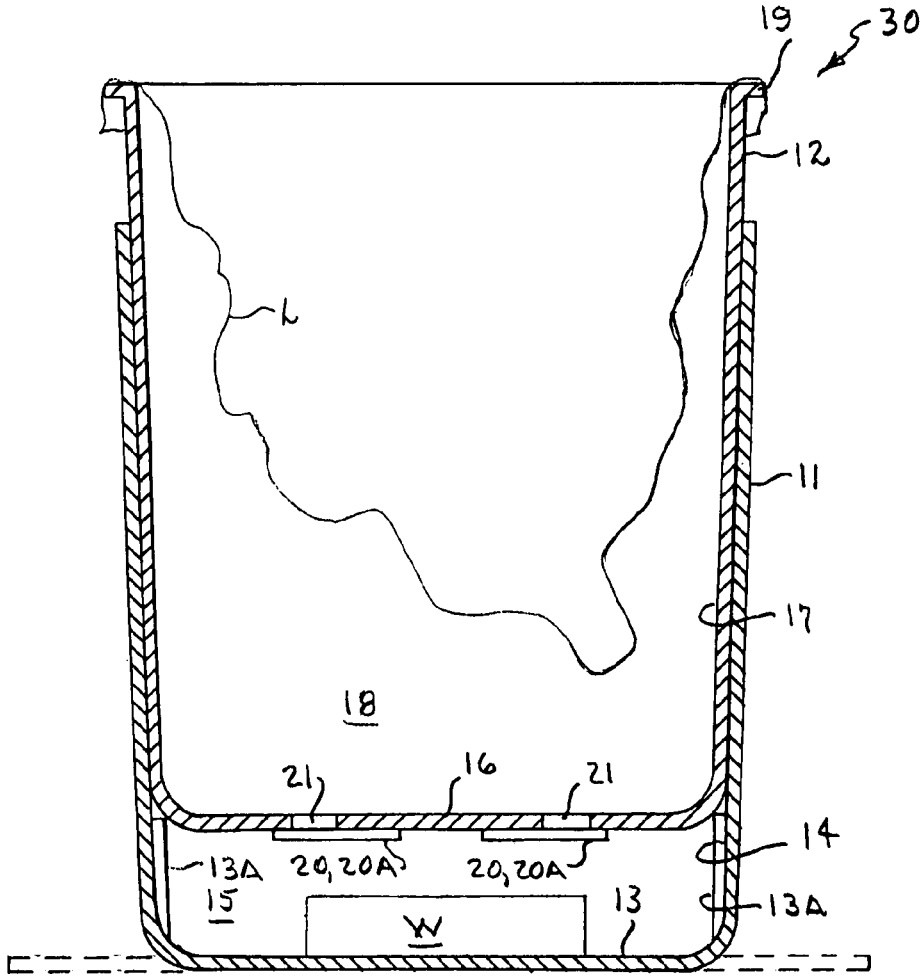
FIGS. 3A, 3B and 3C are longitudinal cross sectional views a second embodiment of the trash receptacle having an outer base member with hold-down means, showing the inner receptacle in its at rest position, being raised, and being lowered, respectively.

Referring now to FIG. 3A, the inner receptacle member 12 of the trash receptacle 10 is shown in its lowermost position nested within the outer base member 11. In this position, the one-way valve means 20 of the inner receptacle member 12 are in a closed or neutral position. A flexible trash bag liner L is opened and placed into the inner receptacle member 12 and its open end is fitted over the lip 19 at the top end of the inner receptacle member, as described previously.

Figure 3B:
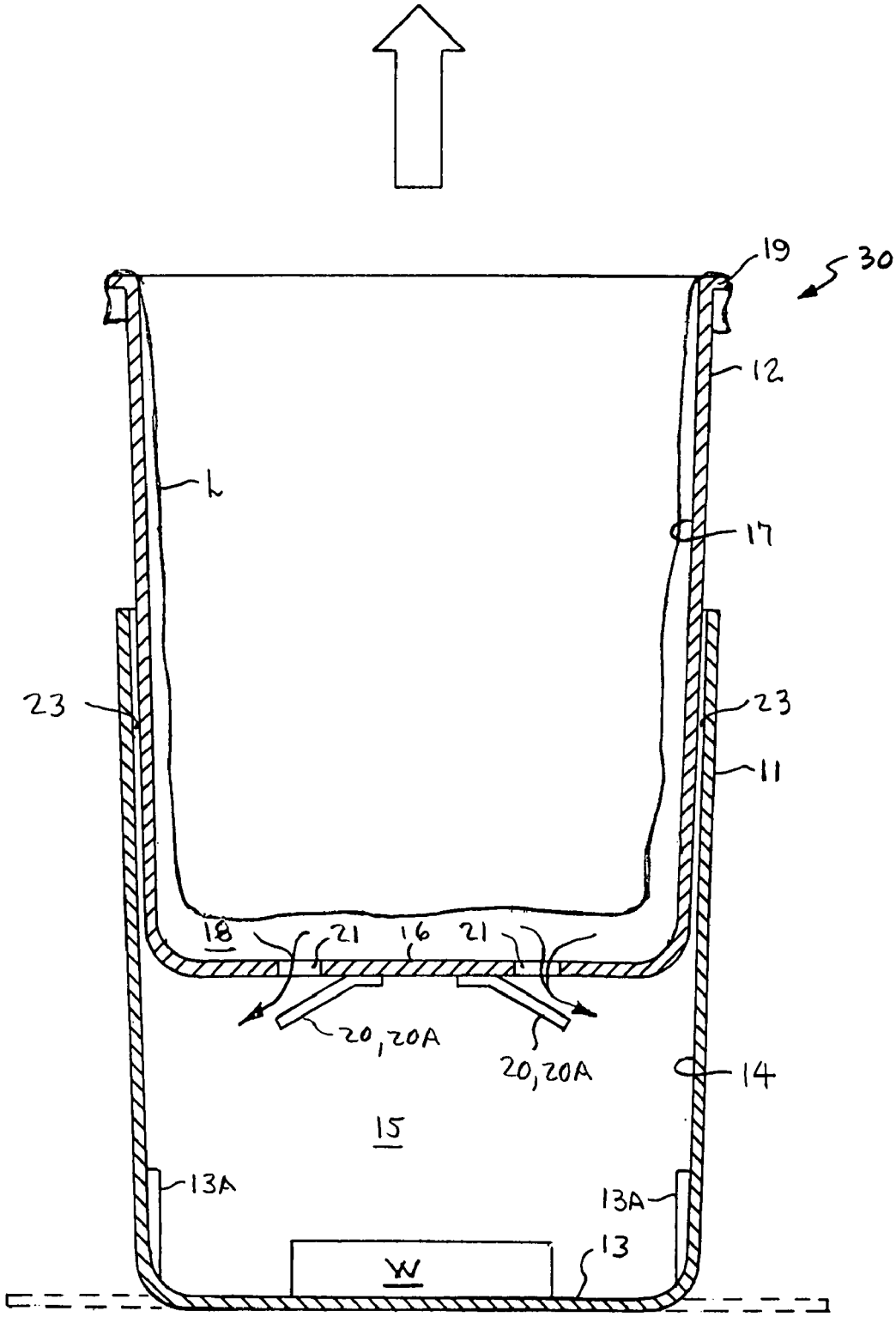

In this embodiment, as seen in FIG. 3B, the user lifts the inner receptacle member 12 upwardly relative to the outer base member 11. As the bottom wall 16 of the inner receptacle member 12 moves upwardly, it acts as a piston moving in the lower chamber 15 of the base member 11. The angle of the tapered side walls 17 and 14 allows them to separate slightly as the inner receptacle moves upward to form a small annulus or gap 23 therebetween, but the angle is sufficiently small to allow only a small volume of air to enter through the annulus or gap. The volume of the lower chamber 15 increases as the inner receptacle member 12 moves upwardly and air pressure in the lower chamber is reduced relative to that of the ambient air pressure inside the inner receptacle member 12 and liner L installed therein. As the inner receptacle member 12 moves upwardly, the one-way valve means 20 at its bottom is moved to its open position due to the higher air pressure in the central chamber 18, thereby allowing air to be extracted into the lower chamber 15 due to its relatively lower pressure. The volume of air entering through the annulus or gap 23 is much less than the volume of air trapped between the exterior of the liner L and interior surfaces of the inner receptacle member 12 during the initial stroke movement. Thus, a large volume of the air trapped between the exterior of the liner L and interior surfaces of the inner receptacle member 12 is extracted into the lower chamber 15. As the trapped air is extracted into the lower chamber 15, a vacuum is created between the exterior of the liner L and interior surfaces of the inner receptacle member 12 which sucks or draws the flexible liner toward the interior surfaces of the bottom wall 16 and peripheral side wall 17 of the inner receptacle until it is drawn tight against said surfaces.

Figure 3C:
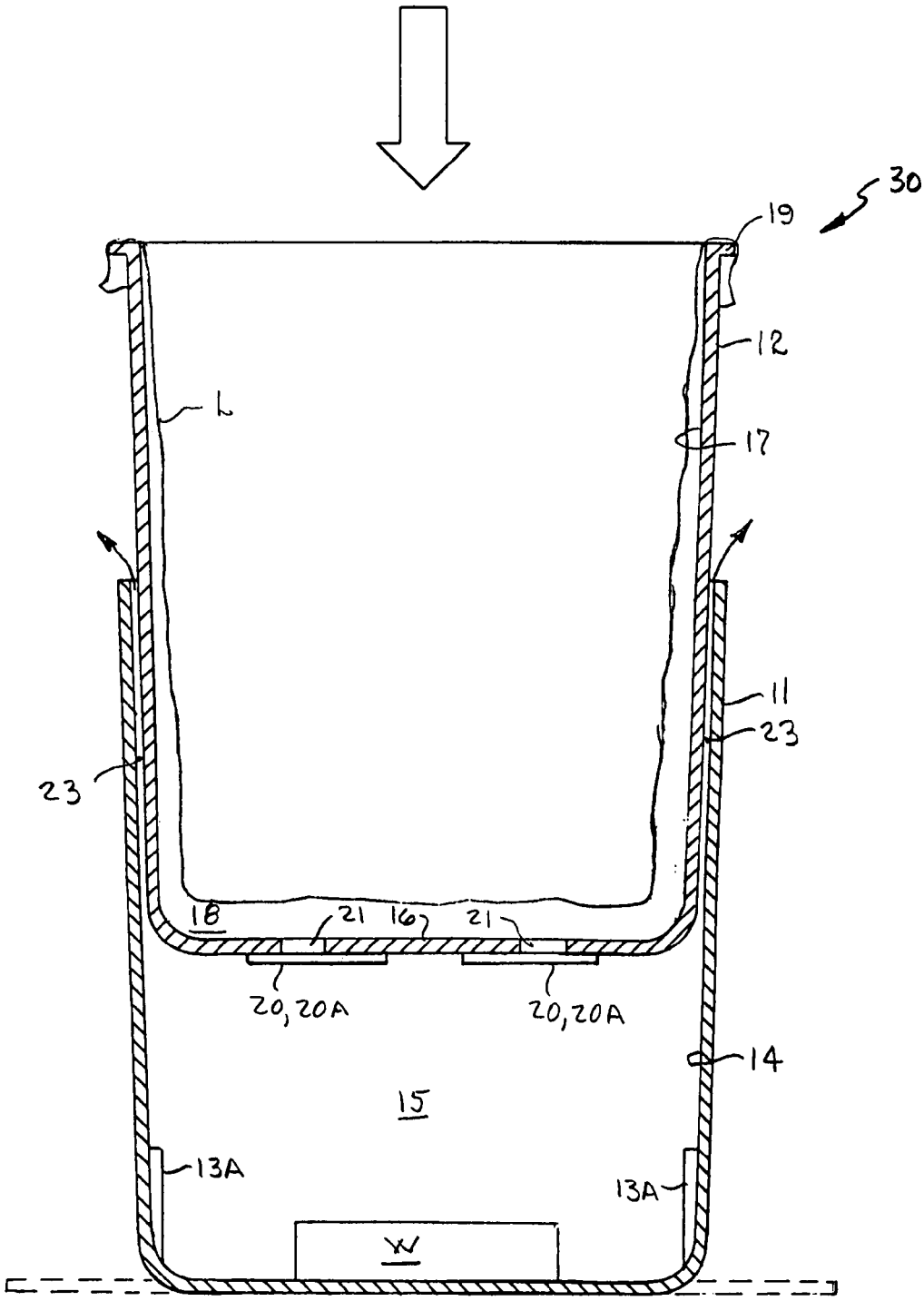

Referring now to FIG. 3C, the user then pushes the inner receptacle member 12 with the liner L therein downward relative to the outer base member 11. As the bottom wall 16 of the inner receptacle member 12 moves downwardly, it acts as a piston moving downwardly in the lower chamber 15 of the base member 11. The volume of the lower chamber 15 decreases and creates a greater air pressure therein that is greater than the ambient air pressure on the inside of the liner L and exterior of base member 11. The greater air pressure in the lower chamber 15 causes the one-way valve means 20 of the inner receptacle member 12 to move to their closed position thereby preventing air from entering between the exterior of the liner L and the interior surfaces of the inner receptacle member. At the same time, the air in the lower chamber 15 passes though the annulus or gap 23 between the side walls 17 and 14, allowing air to be expelled from the lower chamber 15 to the exterior of the base member until the tapered side walls are touching to close the annulus or gap 23.

Thus, with several simple up and down strokes of the inner receptacle member 12, the user is provided with a trash receptacle having a removable liner that is drawn tight against the interior surfaces of the inner receptacle member in a full open position and absent any air pockets or billowing and which allows unobstructed use of the full volume of the trash receptacle.

After the liner L has been filled with trash, it may be removed by removing its top end from the lip and gathering it together, thereby releasing the vacuum between the exterior of the liner and the interior surfaces of the inner receptacle member 12, and pulling the liner upwardly from the inner receptacle member, as described previously.

It should be understood that the trash receptacle may be provided with a foot pedal or hand lever and associated linkages for raising and lowering the inner receptacle member 12 relative to the base member 11.

It should also be understood that the two-piece trash receptacles may be provided with guide means between the tapered side walls to control the travel path to the inner receptacle member, and to reduce or prevent wobbling or looseness between the components as the inner receptacle member is moved upward relative to the base member. For example, one or more straight vertical rails may be provided on the side wall of either the base member or the inner receptacle member which are slidably engaged in vertical grooves on the other one of the base member or inner receptacle member. As another example, one or more elongate resilient leaf springs may be provided on the side wall of either the base member or the inner receptacle member which are biased outwardly and slidably engaged on the outer surface or in longitudinal grooves on the other one of the base member or inner receptacle member.

Double Valve Embodiment

Referring now to FIGS. 4, 4A, 4B and 4C, there is shown another embodiment of the trash receptacle 40 having a double valve venting arrangement. The receptacle 40 comprises an outer base member 41 and an inner receptacle member 42 for receiving and supporting a trash bag liner L therein.

The outer base member 41 has a bottom wall 43 and a peripheral side wall 44 extending upwardly therefrom circumscribing a lower chamber 45 with an open top end. At least one first one-way valve means 46 is disposed on the side wall 44 closely adjacent to the bottom wall 43 for venting air only out of the lower chamber 45, as described hereinafter.

Figure 5:
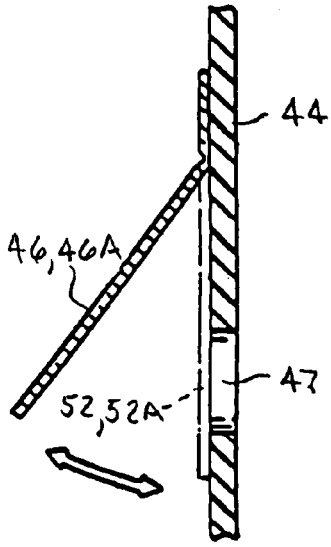

FIG. 5 shows an enlarged detail of the first one-way valve means 46. One or more apertures 47 are formed in the side wall 44 of the base member 41 near the bottom wall 43 for venting air out of the lower chamber 25. A semi-rigid flexible strip 46A has a first portion secured to the side wall 44 of the base member 41 and a second portion which is free to pivot or flex. The second portion of the strip 46A pivots or flexes upon air entering or leaving the lower chamber 45 and operates as a flapper valve to move between a closed position covering the apertures 47 to prevent air from entering and an open position extended away from the apertures to allow air to be expelled therethrough.

The inner receptacle member 42 has a bottom wall 48 and a peripheral side wall 49 extending upwardly therefrom circumscribing a central chamber 50 with an open top end surrounded by a lip 51. The lower portion of the peripheral side wall 49 of the inner receptacle member 42 is sized and shaped to be slidably received inside the peripheral side wall 44 of the outer base member 41 and to reciprocate telescopically in the lower chamber 45 relative to the base member 41. The peripheral side wall 49 may have a peripheral shoulder 49A that engages the top edge of the base member 50 when the container member 42 is in its lowermost position. At least one second one-way valve means 52 is disposed on the side wall 49 closely adjacent to the bottom wall 48 for venting air only out of the central chamber 41, as described hereinafter.

Figure 6:
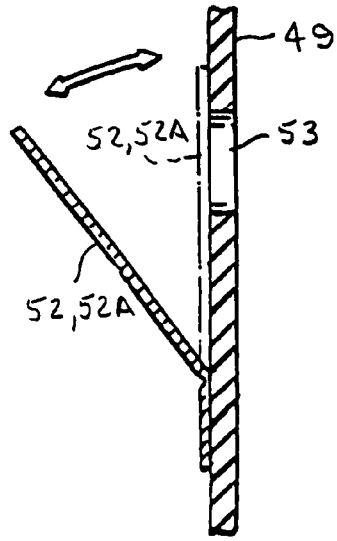
FIGS. 5 and 6 are partial cross sections of the first and second one-way flapper valve elements.

FIG. 6 shows an enlarged detail of the second one-way valve means 52. One or more apertures 53 are formed in the side wall 49 wall of the inner receptacle member 42 near its bottom wall 48, or alternatively in the bottom wall 48, for venting air out of the central chamber 50. A semi-rigid flexible strip 52A has a first portion secured to the side wall 49 of the inner receptacle 42 and a second portion which is free to pivot or flex. The second portion of the strip 52A pivots or flexes upon air entering or leaving the central chamber 50 and operates as a flapper valve to move between a closed position covering the apertures 53 to prevent air from entering, and an open position extended away from the aperture to allow air to be expelled therethrough.

The outer base member 41 may be provided with generally flat extensions 54 which extend outwardly in a horizontal plane from the bottom wall 43 in laterally opposed relation, for receiving the feet of a user to hold the lower base member down against the upward force of the inner receptacle member 42 during reciprocal movement of the inner receptacle member. The extensions 54 may be retractable. Alternatively, the bottom portion of the side wall 44 may be contoured inwardly to receive the feet of the user, or the base member 41 may be provided other suitable hold-down means as described previously.

It should be understood that the trash receptacle may be provided with a foot pedal or hand lever and associated linkages for raising and lowering the inner receptacle member 42 relative to the base member 41.

Operation of Double Valve Embodiment

Figure 4:
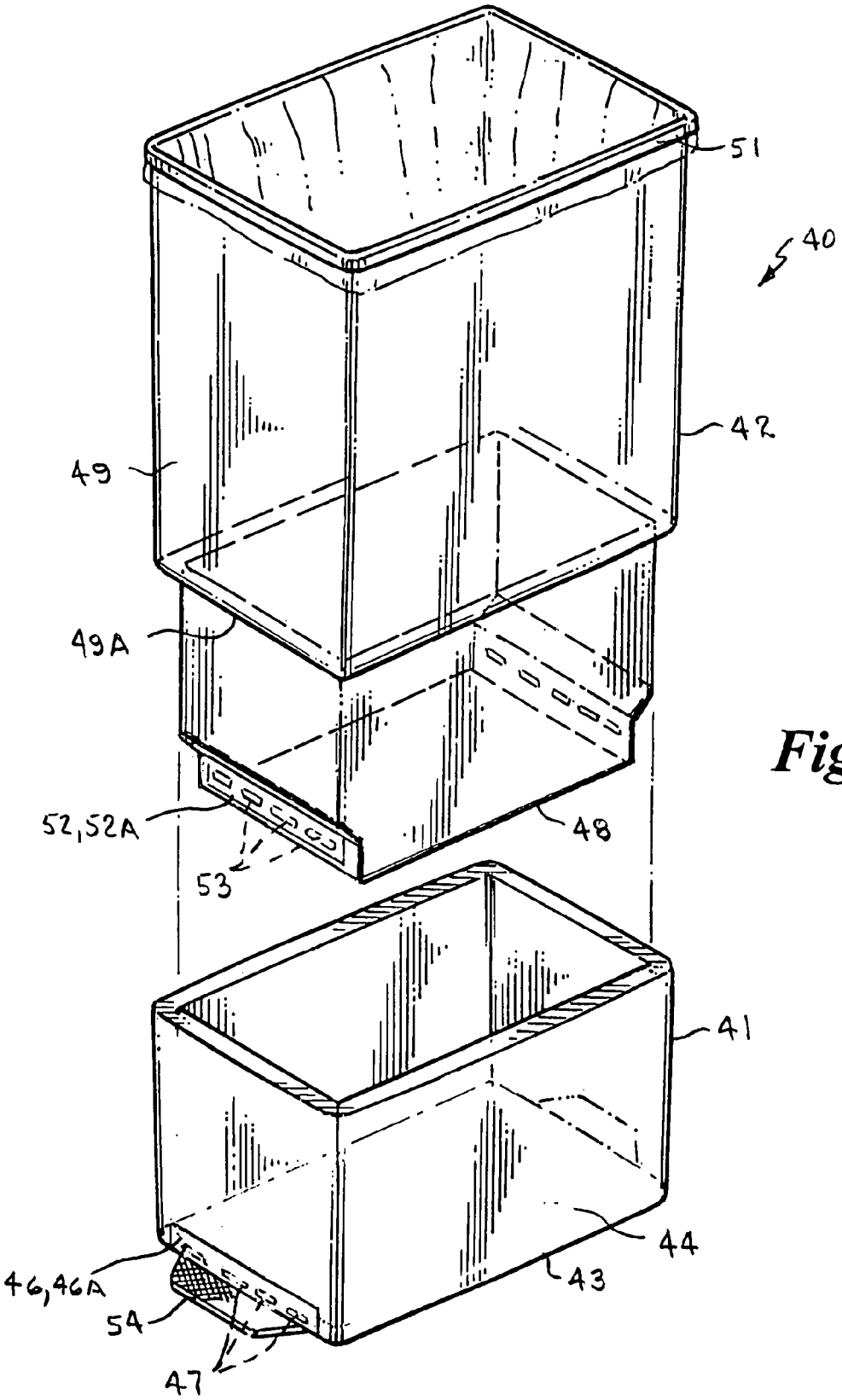
FIG. 4 is an exploded isometric view of a third embodiment of the trash receptacle apparatus having a double valve mechanism.
Figure 4A:
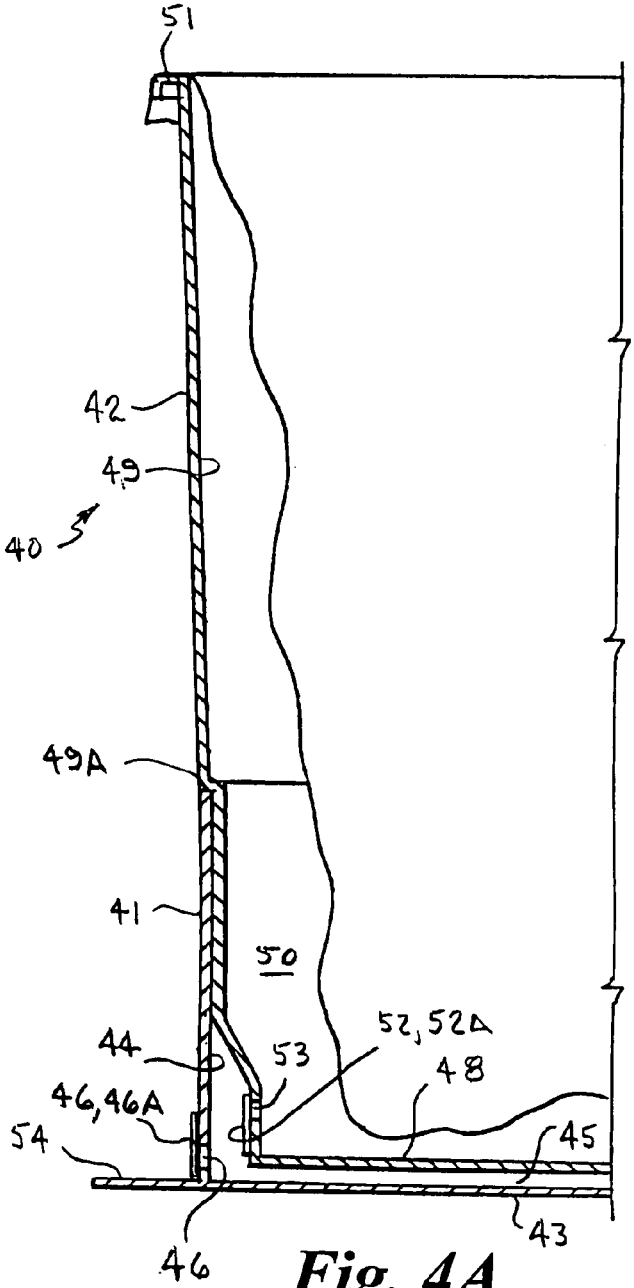
FIGS. 4A, 4B and 4C are longitudinal cross sectional view of the trash receptacle of FIG. 4, showing the inner receptacle in its lowermost position, being raised, and being lowered, respectively.

Referring now to FIG. 4A, the inner receptacle member 42 of the trash receptacle 40 is shown in its lowermost position within the outer base member 41. In this position, the trash receptacle 40 resembles a conventional trash receptacle. Also in this position, both the one-way valve means 46 of the base member 41 and the one-way valve means 52 of the inner receptacle member 42 are in a closed or neutral position. A flexible trash bag liner L is opened and placed into the inner receptacle member 42 and its open end is fitted over the lip 51 at the top end of the inner receptacle member in a conventional manner, forming a seal. As the liner L is installed, air is trapped between the exterior of the liner and the interior surfaces of the bottom wall 48 and peripheral side wall 49 of the inner receptacle member 42 causing the liner to puff up or billow inwardly away from the interior bottom and side surfaces.

Figure 4C:
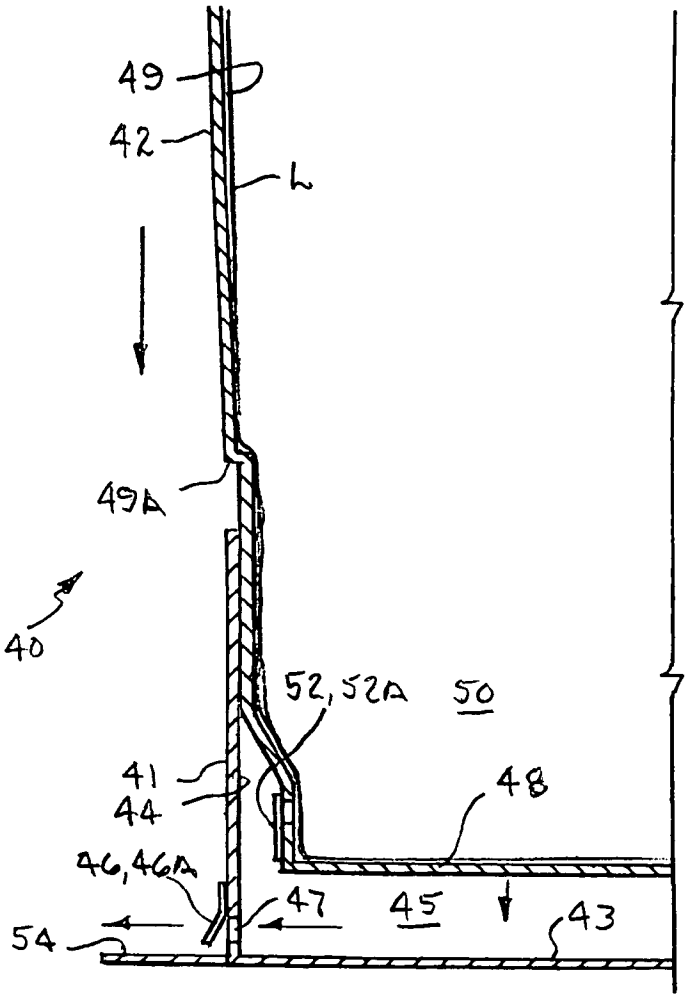
Figure 4B:
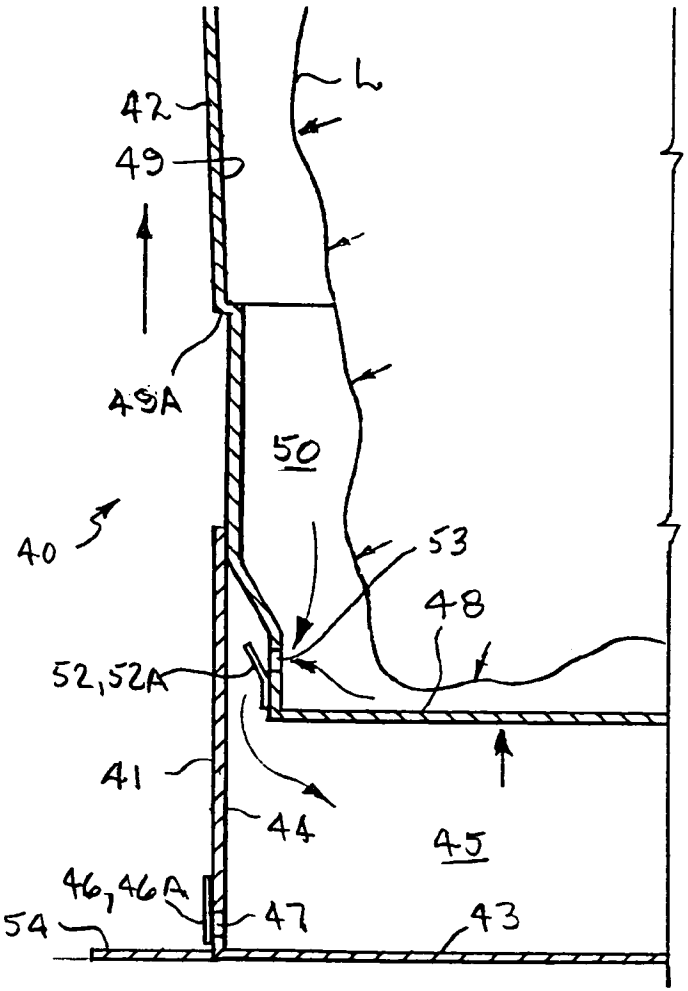

Referring now to FIG. 4B, the user places his or her feet on the flat extensions 54 and lifts the inner receptacle member 42 upwardly relative to the outer base member 41. As the bottom wall 48 of the inner receptacle member 42 moves upwardly, it acts as a piston moving in the lower chamber 45 of the base member 41. The volume of the lower chamber 45 increases as the inner receptacle member 42 moves upwardly and air pressure in the lower chamber is reduced relative to that of the ambient air pressure inside the inner receptacle member and liner therein and the ambient air exterior of the base member 41. The negative pressure in the lower chamber 45 causes the one-way valve means 46 of the base member 41 to close, preventing air from entering from outside the base member. At the same time, the one-way valve means 52 of the inner receptacle member 42 is moved to its open position as the inner receptacle member moves upward due to the higher air pressure in the central chamber 50, thereby allowing air to be extracted into the lower chamber 45 due to its relatively lower pressure. The only air available to move into the lower chamber 45 is the air trapped between the exterior of the liner L and interior surfaces of the inner receptacle member 42. As the trapped air is extracted into the lower chamber 45, a vacuum is created between the exterior of the liner and interior surfaces of the inner receptacle 42 which sucks or draws the flexible liner toward the interior surfaces of the bottom wall 48 and peripheral side wall 49 of the inner receptacle until it is drawn tight against said surfaces.

Referring now to FIG. 4C, after the trapped air has been extracted into the lower chamber 45, the user then pushes the inner receptacle member 42 with the liner L therein downward relative to the outer base member 41. As the bottom wall 48 of the inner receptacle member 42 moves downwardly, it acts as a piston moving downwardly in the lower chamber 45 of the base member 41. The volume of the lower chamber 45 decreases and creates a greater air pressure therein which is greater than the ambient air pressure on the inside of the liner L and inner receptacle member and the air pressure exterior of base member 41. The greater air pressure in the lower chamber 45 causes the one-way valve means 52 of the inner receptacle member 42 to move to its closed position thereby preventing air from entering between the exterior of the liner L and the interior surfaces of the inner receptacle member. At the same time, the greater air pressure in the lower chamber 45 causes the one-way valve means 46 of the base member 41 to open, allowing air to be expelled from the lower chamber to the exterior of the base member through the valve means 46.

Thus, with several simple up and down strokes of the inner receptacle member 42, the user is provided with a trash receptacle having a removable liner that is drawn tight against the interior surfaces of the inner receptacle member in a full open position and absent any air pockets or billowing and which allows unobstructed use of the full volume of the trash receptacle.

To remove the liner L after it has been filled with trash, the user grasps the open top end of the liner and gathers it together, thereby releasing the vacuum between the exterior of the liner and the interior surfaces of the inner receptacle member 42, and places his or her feet on the flat extensions 54 and pulls the liner upwardly from the inner receptacle member. The upward movement of the departing filled liner L relative to the inner receptacle member 42 may create a small vacuum between the liner exterior and the interior surfaces of the inner receptacle member which may tend to pull the inner receptacle member upwardly relative to the base member. However, as the liner is lifted, the one-way valve means 52 of the inner receptacle member 42 will be moved to its closed position and the one-way valve means 46 of the base member 41 will also be moved from its open position to its closed position thereby precluding air from entering into either the base member chamber 45 or the interior of the inner receptacle member 42 and thereby preventing the inner receptacle member from moving upwardly relative to the base member. Removal of the liner is also facilitated in that the base member is firmly engaged on the supporting surface by the user standing on the flat extensions 54 as the liner is pulled from the trash receptacle.

With respect to all of the above described embodiments having one-way valve means, it should be understood that the flapper valve arrangement is illustrated as an example and that other one-way valve means may employed, such as conventional check valves or equivalent mechanisms.

Although the two-piece trash receptacle embodiments have been described as having an inner receptacle member that is movable relative to an outer base member, it should be understood that the base member may be movable relative to the inner receptacle member. For example, in smaller wastebasket sizes having the above described valves and vent means, the base member and/or the inner receptacle member may be provided with a handle or hand grip, wherein after the liner has been loosely installed and fitted over the top lip, the user may grip the base member with one hand and the inner receptacle member in the other hand and move the members relative to one another by pushing them together and pulling them apart.

Movable Bottom Embodiment

Figure 7:
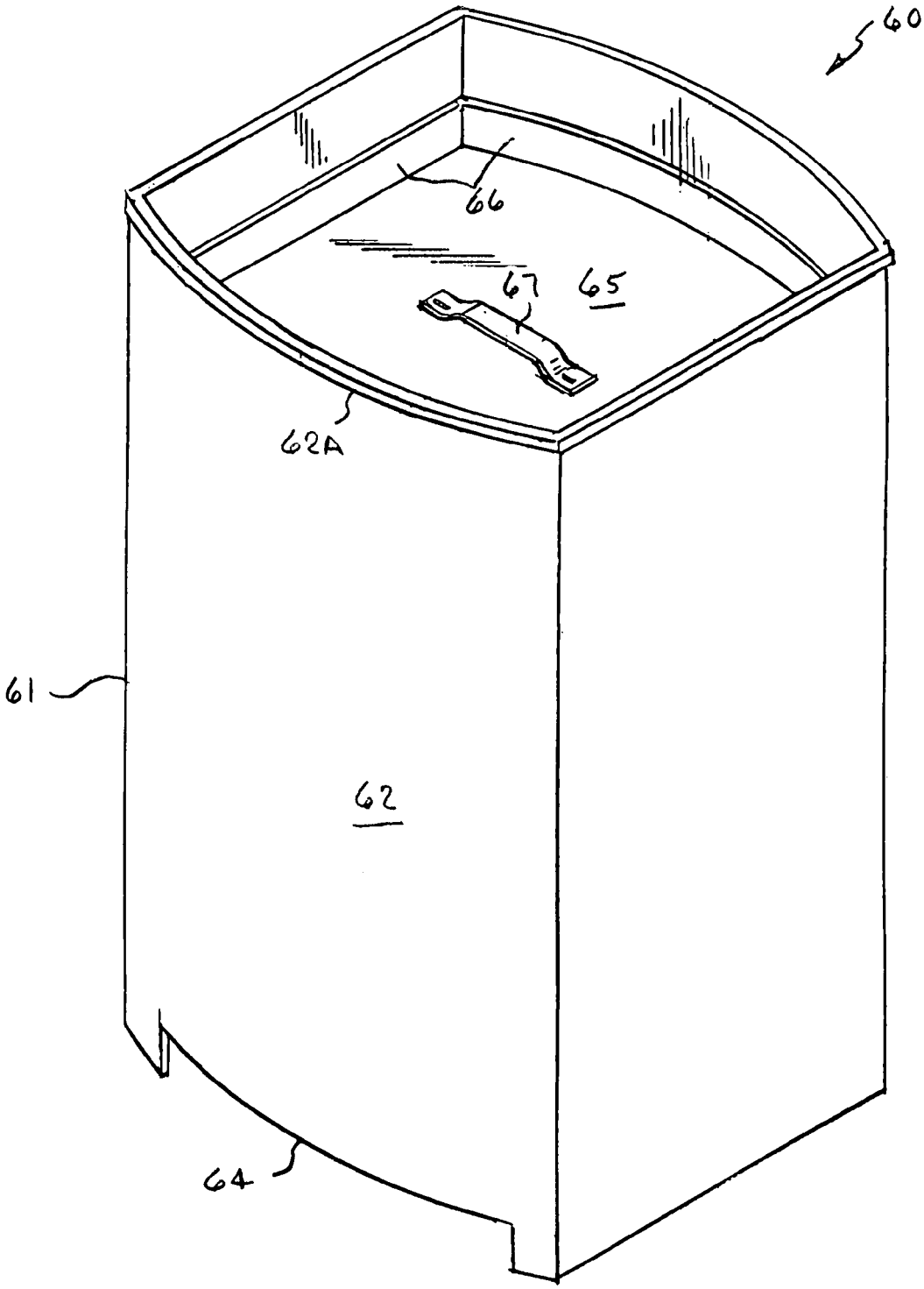
FIG. 7 is an isometric view of a fourth embodiment of the trash receptacle having a movable bottom wall.
Figure 7B:
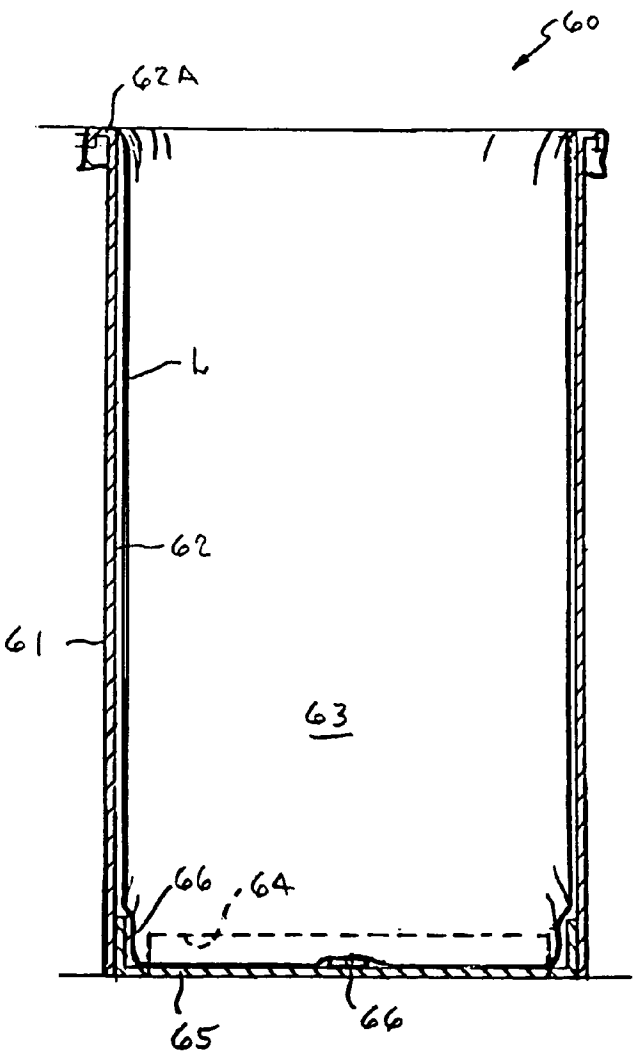
FIGS. 7A and 7B are longitudinal cross sectional views of the embodiment of FIG. 7, showing the movable bottom wall being lowered from its upper position, and in its lowermost position, respectively.
Figure 7A:
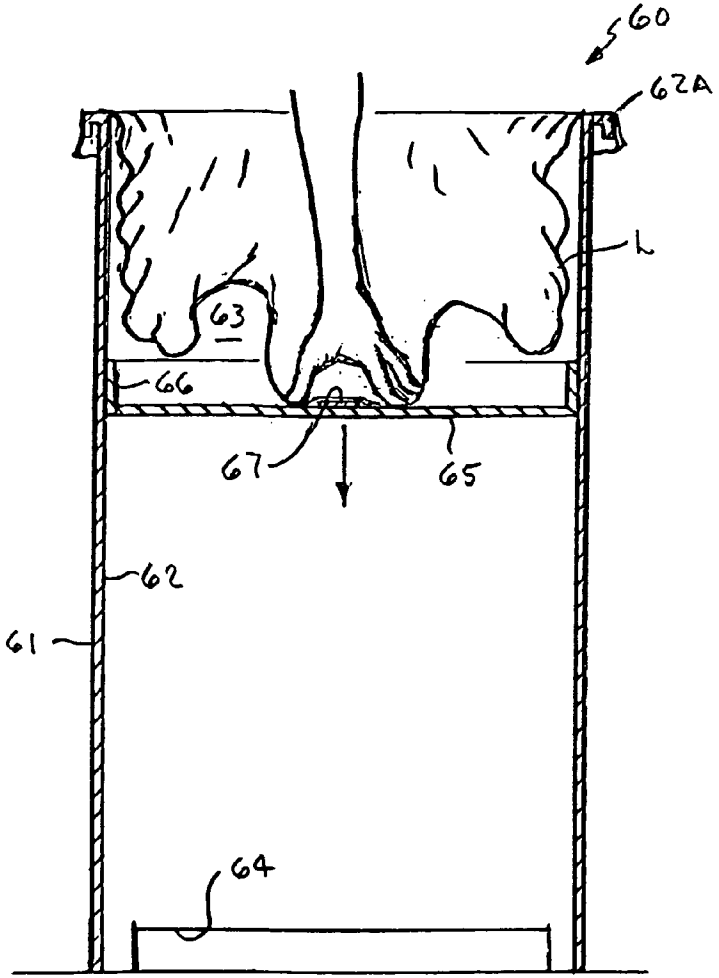

Referring to FIGS. 7, 7A and 7B, there is shown another embodiment of the trash receptacle 60 having a stationary receptacle 61 with a movable bottom wall 65.

The receptacle 61 has a longitudinally extending peripheral side wall 62 circumscribing a central chamber 63 with an open top end surrounded by a lip 62A and an open bottom end which is supported on a support surface. The lower portion of the side wall 62 is provided with one or more openings or slots 64 that extend vertically upward a distance from the bottom edge of the receptacle and support surface to serve as an air vent or air passageway, as described hereinafter. The remaining portion of the bottom edge of the receptacle 61 is supported on the support surface to maintain it in a vertically upright and stable position.

A movable bottom wall 65 is slidably disposed in the central chamber 63. The bottom wall 65 serves as the bottom wall of the central chamber 63 and has an outer perimeter side wall 66 sized and shaped to slidably engage the inner facing surface of the peripheral side wall 62 of the receptacle 61. The top surface of the bottom wall 65 is provided with a hand grip means such as a handle 67 which may be gripped by the user to manually move the bottom wall upwardly or downwardly in the central chamber 63. The handle 67 may be retractable so as to lay flat on the top surface of the tray bottom and be manually raised for gripping by the user.

In a preferred embodiment, the outer perimeter side wall 66 of the bottom wall 65 is in the form of an upstanding peripheral skirt that slidably engages the inner facing surface of the perimeter side wall 62 of the receptacle 61 and has a length which is somewhat greater than the height of the openings or slots 64 at the bottom end of the receptacle. As described hereinafter, the bottom wall 65 is moved to its uppermost position to install the flexible trash bag liner. In its lowermost position, the bottom surface of the bottom wall 65 will engage the support surface or floor and its peripheral skirt will cover the openings or slots 64 from the inside of the receptacle.

Alternatively, the outer perimeter side wall 66 of the bottom wall 65 may be tapered and provided with a flexible boot or seal at its upper end that engages the inner facing surface of the perimeter side wall 62 of the receptacle 61 in a sliding seal relation.

Operation of Movable Bottom Embodiment

Referring now to FIG. 7A, the bottom wall 65 is shown in an upper position within the central chamber 63 of the receptacle 61 near its top end. In this position, the bottom wall 65 shortens the central chamber 63, thus reducing its volume. A flexible trash bag liner L is opened and placed into the central chamber 63 of the receptacle 61 and its open end is fitted over the lip 62A at the top end of the receptacle in a conventional manner, forming a seal. When the top end of the liner L is fitted over the lip 62A, air is trapped between the exterior of the liner and the interior facing surfaces of the peripheral side wall 62 of the receptacle and top surface of the bottom wall 65 causing the liner to puff up or billow inwardly away from the interior facing surfaces of the receptacle and bottom wall.

The user then places his or her hand into the center of the empty liner L, presses its bottom against the top surface of the bottom wall 65, and pushes them downward relative to the receptacle 61, thereby increasing the volume of the central chamber 63. As the bottom wall 65 moves downwardly, it acts as a downward moving piston and attempts to draw air into the central chamber 63. Ambient air can fill the interior of the liner L as the volume expands. However, since the top end of the liner is fitted over the lip 62A at the top end of the receptacle, air is prevented from entering around the exterior of the liner. Thus, as the bottom wall 65 moves down, air pressure between the exterior of the liner L and interior surfaces of the central chamber 63 is reduced relative to that of the ambient air pressure inside the liner. Air beneath the bottom wall 65 is exhausted through the openings or slots 64 at the bottom of the receptacle 61.

As the bottom wall 65 moves downwardly, the volume of the central chamber 63 increases, and the pressure of trapped air between the exterior of the liner L and interior surfaces of the central chamber 63 is increasingly reduced relative to the ambient air pressure on the interior of the liner until a vacuum is created between the exterior of the liner and interior surfaces of the receptacle which sucks or draws the flexible liner toward the interior surfaces of the peripheral side wall 62 of the receptacle and the top surface of the bottom wall and it is drawn tight against said surfaces, as shown in FIG. 7B. In its lowermost position, the bottom surface of the bottom wall 65 engages the support surface or floor and the exterior of its peripheral skirt 66 covers the exhaust openings or slots 64 of the receptacle from the inside, and the trash receptacle 60 then resembles a conventional solid trash receptacle.

Thus, with a simple down stroke of the movable bottom wall 65, the user is provided with a trash receptacle having a removable liner that is drawn tight against the interior surfaces of the inner receptacle member in a full open position and absent any air pockets or billowing which allows unobstructed use of the full volume of the trash receptacle.

Flexible Diaphragm Embodiment

Figure 8:
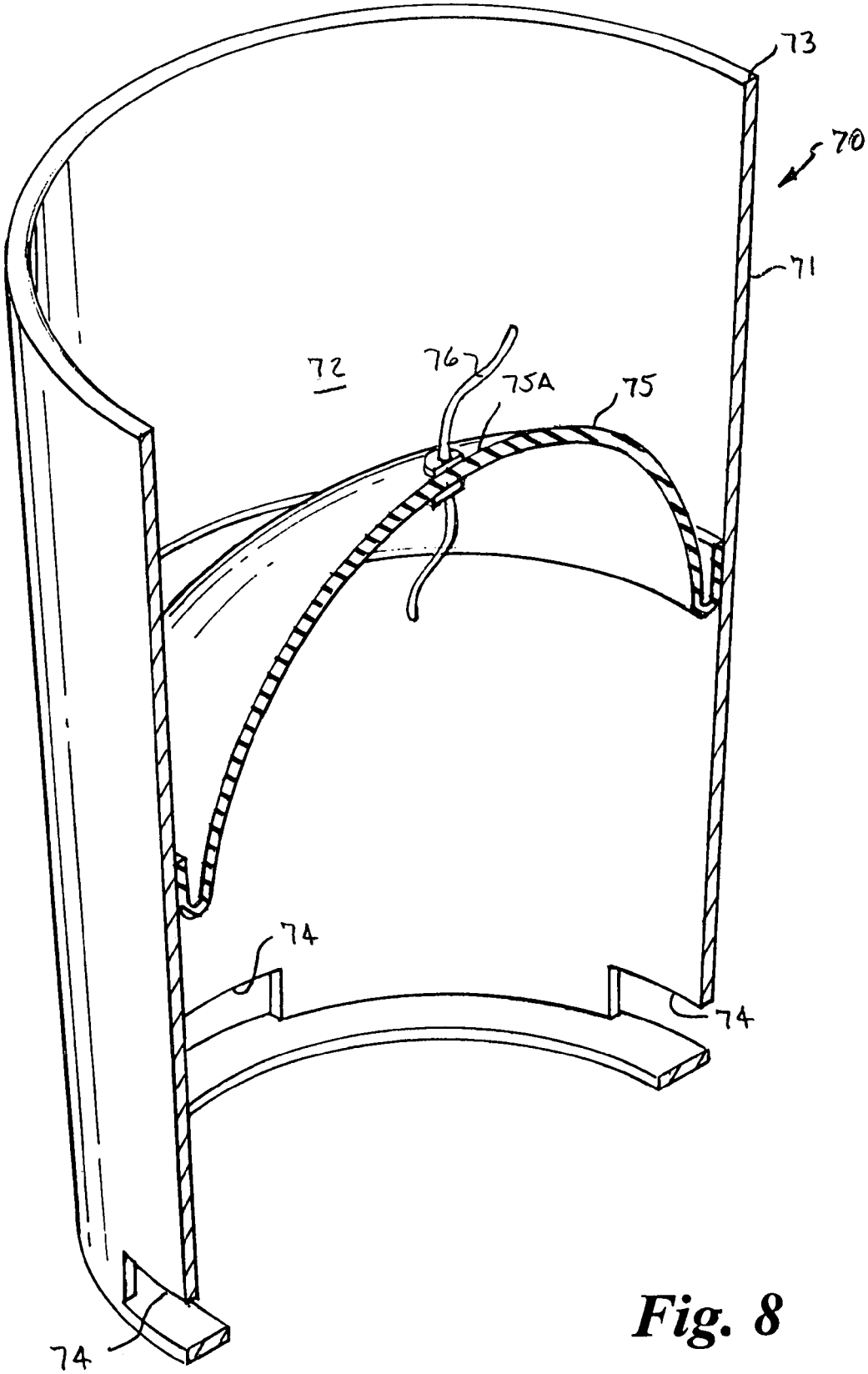
FIG. 8 is an isometric view of a fifth embodiment of the trash receptacle having a flexible diaphragm, partially cutaway to show the flexible diaphragm.
Figure 8A:
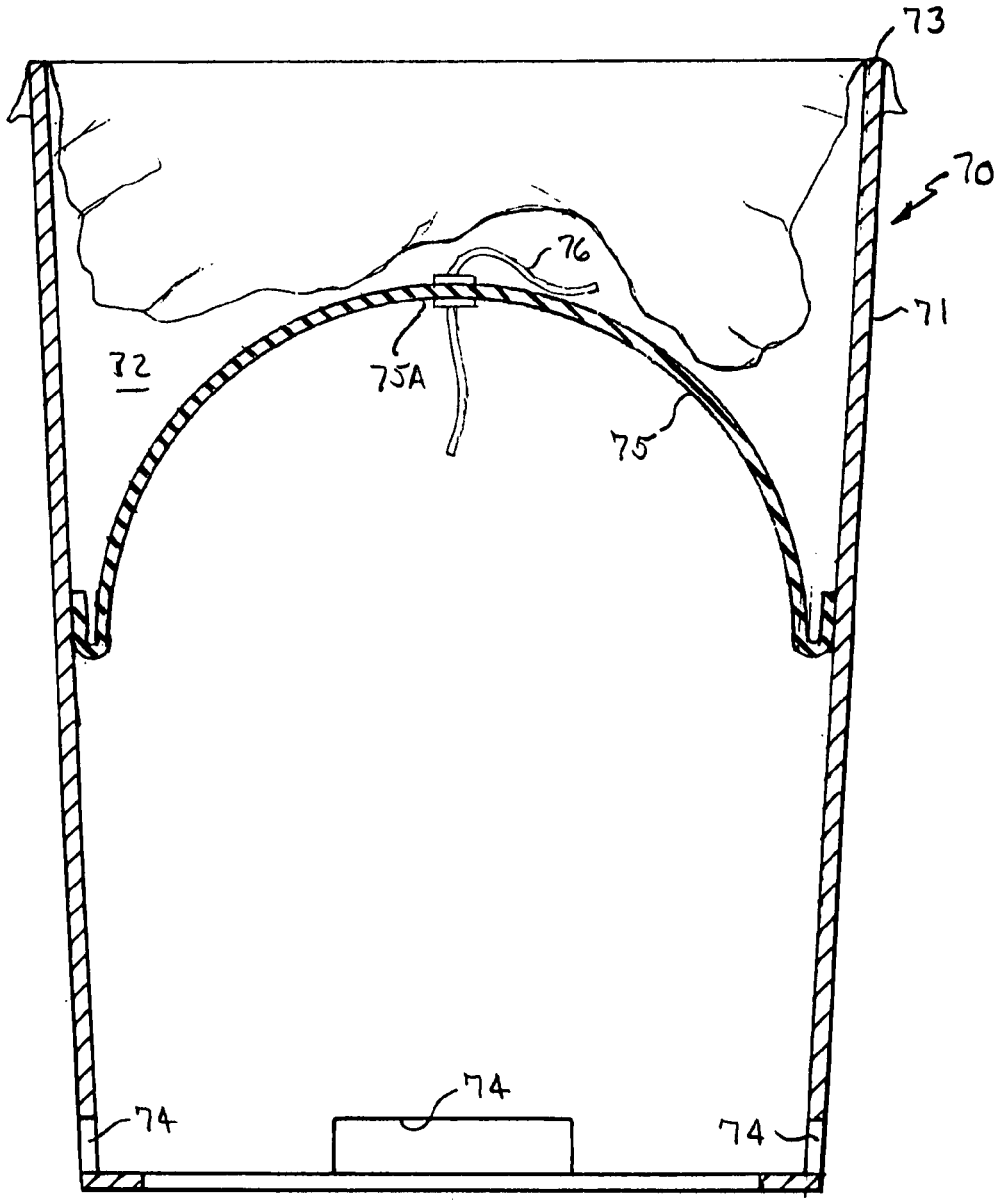
FIGS. 8A and 8B are longitudinal cross sectional views of the embodiment of FIG. 8, showing the flexible diaphragm in its upper position and its lower position, respectively.
Figure 8B:
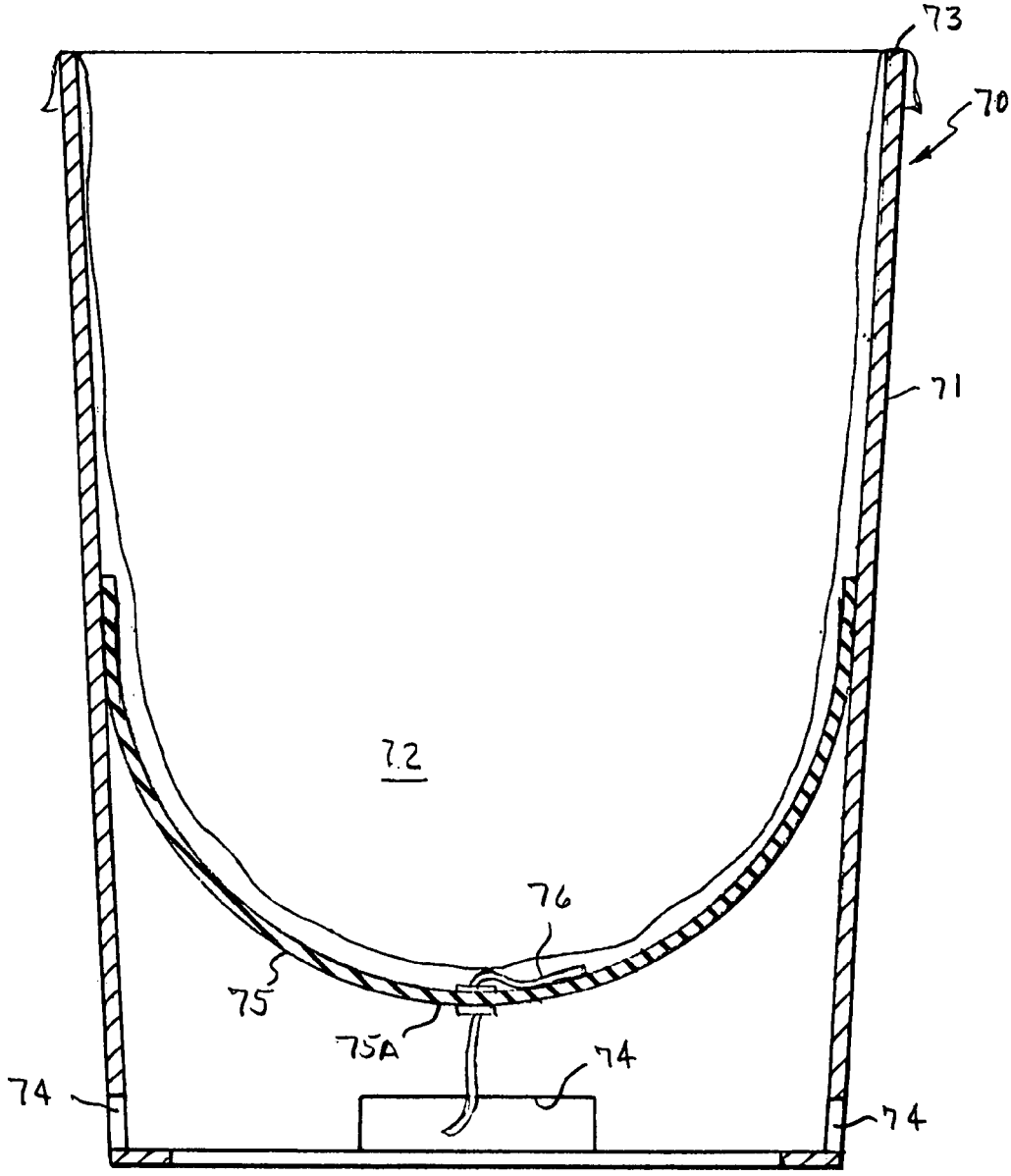

Referring now to FIGS. 8, 8A and 8B, another embodiment of the trash receptacle 70 having a flexible diaphragm 75 is shown. The receptacle 70 has a longitudinally extending perimeter side wall 71 circumscribing a central chamber 72 with an open top end surrounded by a lip 73 and an open bottom end which is supported on a support surface and vented to atmosphere through one or more openings or slots 74 in the lower portion of the side wall.

A flexible diaphragm 75 is disposed in the central chamber 72 with its outer peripheral sides sealingly secured on the interior surface of the side wall 71. The flexible diaphragm 75 is sized and shaped to bow upwardly in a first or raised position and to bow downwardly in a second or lowered position and quickly assume either position as its center portion 75A is moved downwardly or upwardly past its periphery. In its raised position, the center portion 75A of the flexible diaphragm 75 curves upwardly, thus reducing the volume of the central chamber 72, and in its lowered position it curves downwardly, increasing the volume of the central chamber.

Operation of Flexible Diaphragm Embodiment

As shown in FIG. 8A, the center portion of the flexible diaphragm 75 is pulled upwardly manually to assume its upwardly bowed position by suitable handling means, such as a cord, loop, or other suitable hand grip means 76. A flexible trash bag liner L is opened and placed into the central chamber 72 of the receptacle 70 and its open end is fitted over the lip 73 at the top end of the receptacle in a conventional manner, forming a seal. When the top end of the liner L is fitted over the lip 73 at the top end of the receptacle 70, air is trapped between the exterior of the liner and the interior facing surfaces of the peripheral side wall 71 of the receptacle and top surface of the diaphragm 75 causing the liner to puff up or billow inwardly away from the interior facing surfaces of the receptacle and diaphragm. In this position, the area occupied by the upwardly bowed diaphragm 75 reduces the volume of the central chamber 72. The user then places his or her hand into the center of the empty liner L, presses its bottom against the top surface of the upwardly bowed diaphragm 75, and pushes downwardly. As the center portion 75A of the resilient diaphragm 75 moves downward past its periphery, it quickly assumes its downwardly bowed lower position (FIG. 8B). When the diaphragm 75 assumes its downwardly bowed lower position, the volume of the central chamber 72 is rapidly increased. Ambient air can fill the interior of the liner L as the volume expands. However, since the top end of the liner is fitted over the lip 73, air is prevented from entering around the exterior of the liner. Thus, as the diaphragm 75 moves down, the pressure of the air trapped between the exterior of the liner L and interior surfaces of the central chamber 72 is significantly reduced due to the expanding volume, and a vacuum is created between the exterior of the liner and interior surfaces of the central chamber 72 sufficient to suck or draw the flexible liner against said surfaces.

Thus, with a simple down stroke of the flexible diaphragm 75, the user is provided with a trash receptacle having a removable liner that is drawn tight against the interior surfaces of the receptacle in a full open position and absent any air pockets or billowing which allows unobstructed use of the full volume of the trash receptacle.

Hand Pump Embodiment

Figure 9:
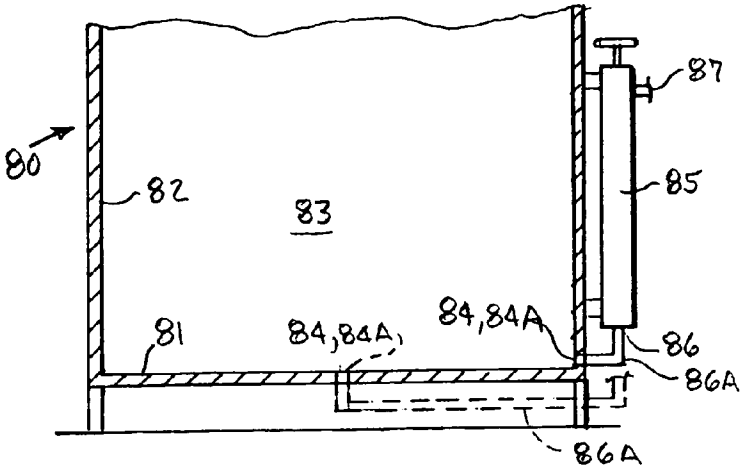
FIG. 9 is a longitudinal cross sectional view of the lower portion of a sixth embodiment of the trash receptacle having a manual pump, shown somewhat schematically.

FIG. 9 shows, somewhat schematically, the lower portion of an embodiment of the trash receptacle 80 having a manually operable hand pump mechanism 85. In this embodiment, the one-way valve means is contained within the hand pump 85. The trash receptacle 80 is similar to a conventional trash receptacle having a bottom wall 81, a peripheral side wall 82 extending upwardly therefrom circumscribing a central chamber 83 with a lip surrounding an open top end (not shown). An aperture 84 is formed through the side wall 82 a short distance above the bottom wall 81, or alternatively formed in the bottom wall 81. A manual hand pump 85 is installed on the receptacle. The air intake 86 of the hand pump 85 is connected in fluid communication with the interior of the receptacle 80 by a conduit 86A connected with the aperture 84 and the exhaust 87 of the pump is vented to the atmosphere. A small screen or grating 84A may be installed over the aperture 84 to prevent the liner from being drawn into the aperture or conduit.

In this embodiment, a flexible trash bag liner is opened and placed into the receptacle 80 and its open end is fitted over the lip at the top end of the receptacle (not shown), forming a seal. The user then manually operates the hand pump 85, and the air that is trapped between the exterior of the liner L and the interior facing surfaces of the receptacle is evacuated and expelled to the atmosphere by the pump via its one-way valve means and the liner is drawn tight against the interior surfaces of the receptacle in a full open position, absent any air pockets or billowing.

Although for purposes of explanation and example, a hand pump has been shown and described as being attached to the receptacle, it should be understood that the hand pump may be unattached. Alternatively, a manual bellows or foot pump may be used wherein the air intake of the bellows or foot pump is connected in fluid communication with the interior of the receptacle through an aperture and the exhaust of the bellows or foot pump is vented to the atmosphere. It should also be understood that the receptacle may be provided with a plurality of apertures connected by a manifold wherein the air intake of the pump device is connected in fluid communication with the manifold.

Exhaust Fan Embodiments

Figure 10:
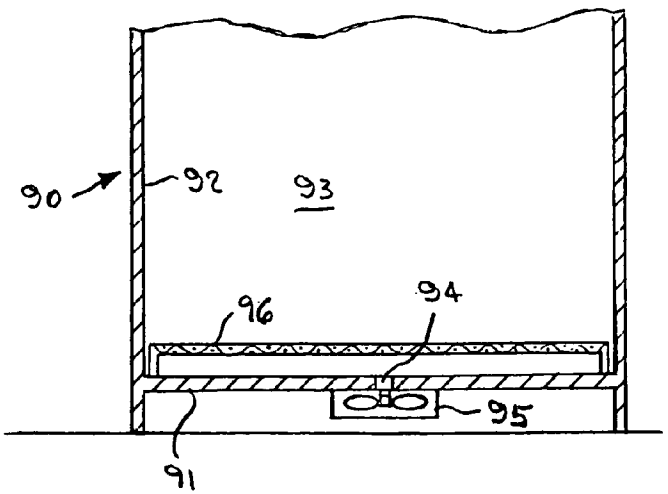
FIG. 10 is a longitudinal cross sectional view of the lower portion of a seventh embodiment of the trash receptacle having an exhaust fan, shown somewhat schematically.

FIG. 10 is a longitudinal cross sectional view of the lower portion of an embodiment of the trash receptacle 90 having an exhaust fan, shown somewhat schematically. In this embodiment, the receptacle 90 has a bottom wall 91 and a peripheral side wall 92 extending upwardly therefrom circumscribing a central chamber 93 with an open top end surrounded by a lip (not shown). At least one aperture 94 is formed in the bottom wall 91 and an exhaust fan 95 is mounted on the bottom wall 91 in communication with the aperture 94. An apertured grid or screen 96 is disposed inside the central chamber 93 above the bottom wall 91. The exhaust fan 95 is connected with a source of electrical power, such as a DC battery or 110 volt AC wall outlet, and controlled by a switch in a conventional manner (not shown).

In this embodiment, a flexible trash bag liner is opened and placed into the receptacle 90 and its open end is fitted over the lip at the top end of the receptacle in a conventional manner, forming a seal. The user then activates the exhaust fan 95 and the air that is trapped between the exterior of the liner and the interior facing surfaces of the receptacle is exhausted through the bottom wall 91 of the receptacle and the liner is drawn tight against the interior surfaces of the receptacle in a full open position and absent any air pockets or billowing. After the liner has been drawn into position, the exhaust fan is deactivated.

The receptacle 90 may also be provided with sensors and operatively connected with the electrical circuit of the exhaust fan to automatically turn the fan on when the liner is placed into the receptacle and with a switch or timer to turn it off when the liner has been drawn into the proper position.

Figure 11:
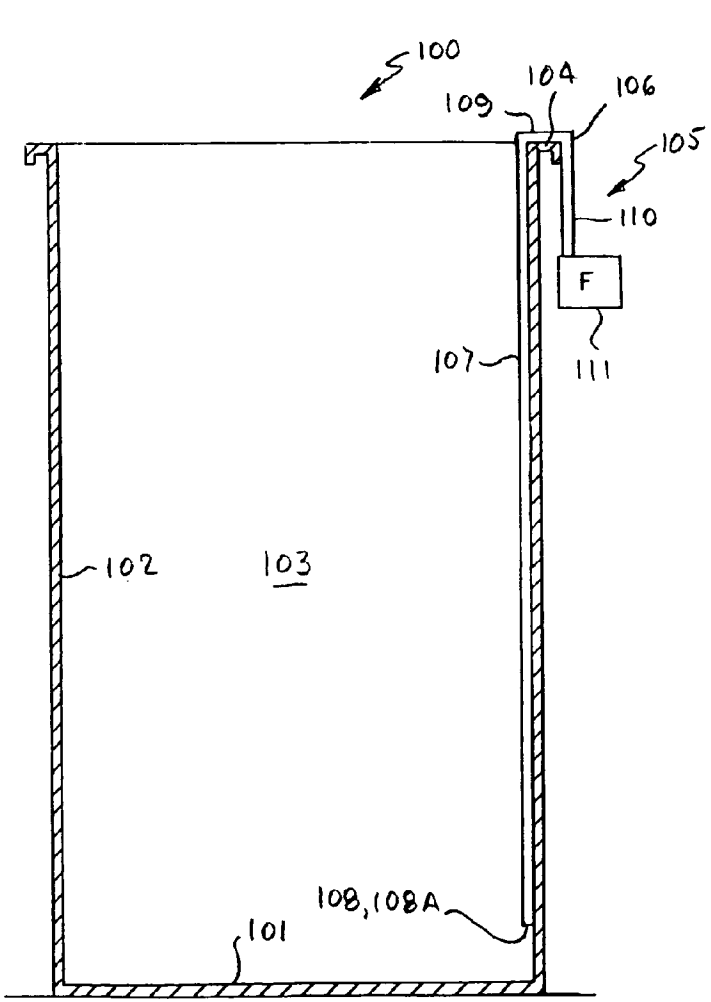
FIG. 11 is a longitudinal cross sectional view of an eighth embodiment of the trash receptacle having a removable exhaust fan.

FIG. 11 shows another embodiment of the trash receptacle 100 having a removable exhaust fan attachment. In this embodiment, the trash receptacle 100 is a conventional trash receptacle having a bottom wall 101 and a peripheral side wall 102 extending upwardly therefrom circumscribing a central chamber 103 with an open top end surrounded by a lip 104, and an exhaust fan attachment 105 is removably installed on the receptacle. The exhaust fan attachment 105 has a tubular exhaust conduit 106 with an elongate vertical section 107, an open bottom end 108, an inverted U-shaped upper portion 109 configured to be removably received on the lip 104 at the top end of the receptacle, and a depending section 110 extending downward from the inverted U-shaped portion. An exhaust fan 111 is mounted at the lower end of the depending section 110 in communication with the interior of the exhaust conduit 106. The exhaust fan 111 is connected with a source of electrical power, such as a DC battery or 110 volt AC wall outlet, and controlled by a switch in a conventional manner (not shown). A small screen or grating 108A may be installed on the open bottom end 108 of the exhaust conduit 106 to prevent the liner from being drawn into the conduit. The elongate vertical section 107 may also be formed of telescoping tubular sections or otherwise adjustable in length so as to position its open bottom end 108 a short distance above the bottom wall 101 of the receptacle 100.

In this embodiment, a flexible trash bag liner is opened and placed into the receptacle 100 and its open end is folded over the lip 104 of the receptacle and the inverted U-shaped section 109 of the exhaust conduit 106. The user then turns the exhaust fan 111 on and the air that is trapped between the exterior of the liner and the interior facing surfaces of the receptacle is drawn through the exhaust conduit 106 and exhausted through the exhaust fan 111 and the liner is drawn tight against the interior surfaces of the receptacle in a full open position and absent any air pockets or billowing. After the liner has been drawn into position, the exhaust fan is turned off. Alternatively, the exhaust fans of the embodiments described above may be powered mechanically such as with a wind-up spring or hand crank, rather than electrical power.

While this invention has been described fully and completely with special emphasis upon preferred embodiments, it should be understood that within the scope of the appended claims the invention may be practiced otherwise than as specifically described herein.

The invention claimed is:

1. A method for eliminating air pockets and billowing when installing an empty flexible trash can liner in a trash receptacle and drawing the empty liner tight against the interior surfaces of the receptacle in a full open position, comprising the steps of:

providing a trash receptacle having an outer base member with a bottom end adapted to be supported on a support surface and a peripheral side wall extending upwardly therefrom circumscribing a lower chamber and terminating in an open top end, an inner receptacle movably disposed in said outer base member having a bottom wall and a peripheral side wall extending upwardly therefrom circumscribing an upper chamber and terminating in an open top end having a rim, and one-way valve means disposed between said upper chamber and said lower chamber for conducting air from said upper chamber;

placing an empty flexible trash can liner in said upper chamber and fitting its open end over said rim; and moving said inner receptacle relative to said outer base member to increase the volume of said lower chamber relative to the volume of said upper chamber to extract air trapped between exterior surfaces of the empty liner and interior surfaces of said upper chamber and create a vacuum therebetween sufficient to eliminate air pockets and billowing and draw the empty liner against said interior surfaces in a full open position.

2. A method for eliminating air pockets and billowing when installing an empty flexible trash can liner in a trash receptacle and drawing the empty liner tight against the interior surfaces of the receptacle in a full open position, comprising the steps of:

providing a trash receptacle having an outer base member with a bottom end adapted to be supported on a support surface and a perimeter side wall extending upwardly therefrom circumscribing a lower chamber terminating in an open top end and an inner receptacle having a bottom wall and a peripheral side wall extending upwardly therefrom circumscribing an upper chamber and terminating in an open top end having a rim, and one-way valve means disposed between said upper chamber and said lower chamber for conducting air from said upper chamber;

said inner receptacle slidably disposed in telescoping relation in said outer base member and movable between a lower position to reduce the volume of said lower chamber and an upper position to increase the volume of said lower chamber;

placing an empty flexible trash can liner in said inner receptacle upper chamber and fitting its open end over said rim; and moving said inner receptacle to its lower position to decrease the volume of said base member lower chamber and close said valve means to prevent passage of air from said base member lower chamber into the area between the exterior surface of the empty liner and the interior surfaces of said upper chamber, and moving said inner receptacle from its lower position to its upper position to increase the volume of said lower chamber and open said valve means such that the increasing volume of said lower chamber reduces the pressure of air trapped between exterior surfaces of the empty liner and interior surfaces of said upper chamber sufficiently lower than the pressure of ambient air inside the empty liner to eliminate air pockets and draw the empty liner against said upper chamber interior surfaces.

3. The method according to claim 2, wherein said inner receptacle side wall and said outer base member side wall are sized and shaped to define a small annulus or gap between the exterior surfaces of said inner receptacle and the interior surfaces of said outer base member; and said step of moving said receptacle to its lower position expels air from said base member lower chamber to the atmosphere through said annulus or gap.

* * * * *